United States Patent [19]

Endo et al.

[11] Patent Number: 4,562,702

[45] Date of Patent: Jan. 7, 1986

[54] EVAPORATION COOLED GAS INSULATED ELECTRICAL APPARATUS

[75] Inventors: Michitada Endo, Suita; Minoru Kimura, Takarazuka, both of Japan

[73] Assignee: Mitsubishi Denki Kabushiki Kaisha, Tokyo, Japan

[21] Appl. No.: 668,872

[22] Filed: Nov. 6, 1984

[30] Foreign Application Priority Data

Nov. 10, 1983 [JP] Japan ..... 58-209802
Nov. 10, 1983 [JP] Japan ..... 58-209803
Nov. 10, 1983 [JP] Japan ..... 58-209804

[51] Int. Cl.[4] ..... F25D 17/02

[52] U.S. Cl. ..... 62/376; 62/78; 62/119; 165/104.21

[58] Field of Search ..... 62/78, 119, 373.6; 165/104.21

[56] References Cited

U.S. PATENT DOCUMENTS 2,499,736 3/1950 Afkleen ..... 62/119
2,875,263 2/1959 Narbut ..... 62/119
3,561,229 2/1971 Levin ..... 62/119
4,188,793 2/1980 Watson et al. ..... 62/119

FOREIGN PATENT DOCUMENTS 54-26688 9/1979 Japan .

*Primary Examiner*—Ronald C. Capossela
*Attorney, Agent, or Firm*—Leydig, Voit & Mayer Ltd.

[57] ABSTRACT

A plurality of upstanding cooling ducts in a condenser are closed at their upper ends and only a lower header which is disposed at the lower ends of the cooling ducts communicates a tank with the cooling ducts. In another embodiment, a check valve and a gas pump are disposed in an upper conduit connecting the tank to a common upper header communicating the cooling ducts with each other at their upper ends so as to discharge the noncondensable gas from the condenser to the tank. Further, a sensing device may be disposed to sense the interface between the noncondensable gas and the vapor refrigerant in the cooling ducts, and a controller may be disposed to compare the interface level sensed by the sensing device with a reference interface level set in the controller to control the gas pump such that the actual interface level is in conformity with the reference interface level.

11 Claims, 20 Drawing Figures

EVAPORATION COOLED GAS INSULATED ELECTRICAL APPARATUS

BACKGROUND OF THE INVENTION

This invention relates to an evaporation cooled gas insulated electrical apparatus and more particularly, improvements of cooling efficiency of the electrical apparatus and reduction in size and weight of a condenser in the electrical apparatus.

In conventional electric devices such as a transformer, the so-called evaporation cooled device is known in which a condensable refrigerant is used as a means for improving the dissipation efficiency of the heat generated from the interior of the device.

Referring to FIG. 1 showing an embodiment of the evaporation cooled device, an electric device 1 generating heat from the interior thereof is disposed in a tank 2 which is filled at a predetermined rate with an electrically insulating noncondensable gas 9 and an electrically insulating condensable liquid refrigerant 5 being capable of evaporating into vapor at an operating temperature of the electric device 1. A liquid pump 6 is connected to the top and bottom portions of the tank 2 through pipes 7 so as to pump the liquid refrigerant 5 collected on the tank bottom through the upper portion of the tank 2, thereby spraying the liquid refrigerant 5 on the electric device 1. A condenser 3 comprises upper and lower headers 4*a* and 4*b* respectively, a lower conduit 12 connecting the lower header 4*b* to the lower portion of the tank 2, an upper conduit 14 connecting the upper header 4*a* to the upper portion of the tank 2, and a plurality of upstanding cooling ducts 10 connected to the upper and lower headers 4*a* and 4*b*, respectively. The liquid refrigerant 5 sprayed on the electrical device 1 absorbes the heat, so that a part of the liquid refrigerant 5 evaporates into a vapor refrigerant 8. The noncondensable gas 9 and the condensable refrigerant 5 are chosen such that the specific weight of the vapor refrigerant 8 is greater than the specific weight of the noncondensable gas 9. Accordingly, the vapor refrigerant 8 flows downward and is collected in the tank lower portion, namely, a part of the vapor refrigerant 8 flows into the cooling ducts 10 through the lower conduit 12 and the lower header 4*b*. Since the cooling ducts 10 dissipates heat while being cooled by a fan 11 disposed near the condenser 3, the vapor refrigerant 8 is liquefied and the heat therefrom is dissipated at a rate corresponding to dissipating capacity of the condenser 3 whereby the refrigerant is utilized as a heat transfer medium. In such a cooling system, since the vapor refrigerant 8 flows downward, the noncondensable gas 9 is thereby forced upward due to the difference in the specific weights thereof, an interface 13 is formed between the vapor refrigerant 8 and the noncondensable gas 9 in the tank 2 and the condenser 3. Specifically, definite interface 13 is not easily formed in the tank 2, since the vapor refrigerant 8 is continuously generated in response to the heat generated in the electric device 1. However, the interface 13 is formed at the interface defined by the volume ratio of the vapor refrigerant to the noncondensable gas corresponding to the pressure within the tank 2. Since the tank 2 is communicated with the condenser 3 through the upper and lower headers 4*a*, 4*b* and the upper and lower conduits 14, 12, respectively, the interface 13 is located at a common level of $H_o$ in both the tank 2 and the condenser 3. The portion of the condenser 3 higher than the interface 13 is filled with the noncondensable gas 9 having a low rate of heat transfer, so that the cooling ducts 10 of the condenser 3 effectively dissipate heat only up to the interface level of $H_o$. Accordingly, even when a large-sized condenser 3 is disposed for the electric device 1, it has the disadvantage in that the cooling efficiency of the cooling ducts is very low.

SUMMARY OF THE INVENTION

A major object of the present invention is to provide an evaporation cooled gas insulated electrical apparatus in which the interface in the cooling ducts is higher than the interface in the tank so as to improve the cooling efficiency of the cooling ducts, thereby enabling the reduction in size of a condenser while maintaining a high heat dissipation capacity.

To achieve the above object, a first embodiment resides in an evaporation cooled gas insulated electrical apparatus, comprising an electric device which generates heat when in operation, a tank containing therein said electric device, an electrically insualting noncondensable gas disposed within said tank, an electrically insulating condensable (vaporizable) liquid refrigerant disposed within said tank, said condensable liquid refrigerant being capable of being evaporated into vapor at the operating temperature of said electric device, the specific weight of said vapor refrigerant being greater than the specific weight of said noncondensable gas, and a condenser connected to said tank for dissipating heat from said condensable refrigerant to condense said refrigerant into liquid comprising a first header communicated to the lower portion of said tank, and a plurality of upstanding cooling ducts extending from said header, said cooling ducts being fluid communicated only through said first header.

Another object of the present invention is to provide an evaporation cooled gas insulated electrical apparatus in which the cooling ducts of a condenser are completely filled at all times with the vapor refrigerant whereby, the heat dissipation efficiency is optimized, thereby providing a high capacity of heat dissipation while allowing the condenser to be small in size.

To achieve the latter object, the present invention also resides in an evaporation cooled gas insulated electrical apparatus, comprising an electric device generating heat when in operation, a tank containing therein said electric device, an electrically insulating noncondensable gas disposed within said tank, an electrically insulating condensable (vaporizable) liquid refrigerant disposed within said tank, said condensable refrigerant being capable of being evaporated at the operating temperature of said electric device, and a condenser connected to said tank for dissipating heat from said condensable refrigerant, said condenser comprising a lower header, a lower conduit connected to the lower portion of said tank for communicating said lower header to the interior of said tank, an upper header, an upper conduit connected to the upper portion of said tank for communicating said upper header to the interior of said tank, a plurality of upstanding cooling ducts extending between said upper and lower headers, a check valve disposed in said upper conduit for allowing the passage of said noncondensable gas from said upper header to said tank, and a gas pump disposed in said upper conduit for pumping said noncondensable gas from said upper header to said tank.

A further object of the present inventions is to provide an evaporation cooled gas insulated electrical apparatus in which the heat dissipation of a condenser is maintained in an optimum state at any time under any loading conditions.

To achieve this object, the present invention also resides in an evaporation cooled gas insulated electrical apparatus, comprising an electric device generating heat when in operation, a tank containing therein said electric device, an electrically insulating noncondensable gas disposed within said tank, an electrically insulating condensable (vaporizable) liquid refrigerant disposed within said tank, said condensable refrigerant being capable of being evaporated at the operating temperature of said electric device, and a condenser connected to said tank for dissipating heat from said condensable refrigerant, said condenser comprising an lower header, an lower conduit connected to the lower portion of said tank for communicating said lower header to the interior of said tank, an upper header, an upper conduit connected to the upper portion of said tank for communicating said upper header to the interior of said tank, a plurality of upstanding cooling ducts extending between said upper and lower headers, a check valve disposed in said upper conduit for allowing the passage of said noncondensable gas from said upper header to said tank, a gas pump disposed in said upper conduit for pumping said noncondensable gas from said upper header to said tank, a sensor means for detecting an interface between a refrigerant vapor and said noncondensable gas, and a control means for controlling the operation of said gas pump in such a manner that said interface is positioned at the same level as a predetermined reference interface.

DESCRIPTION OF THE PREFERRED EMBODIMENTS

The preferred embodiments according to the present inventions will next be explained on the basis of the accompanying drawings.

Figure 1:
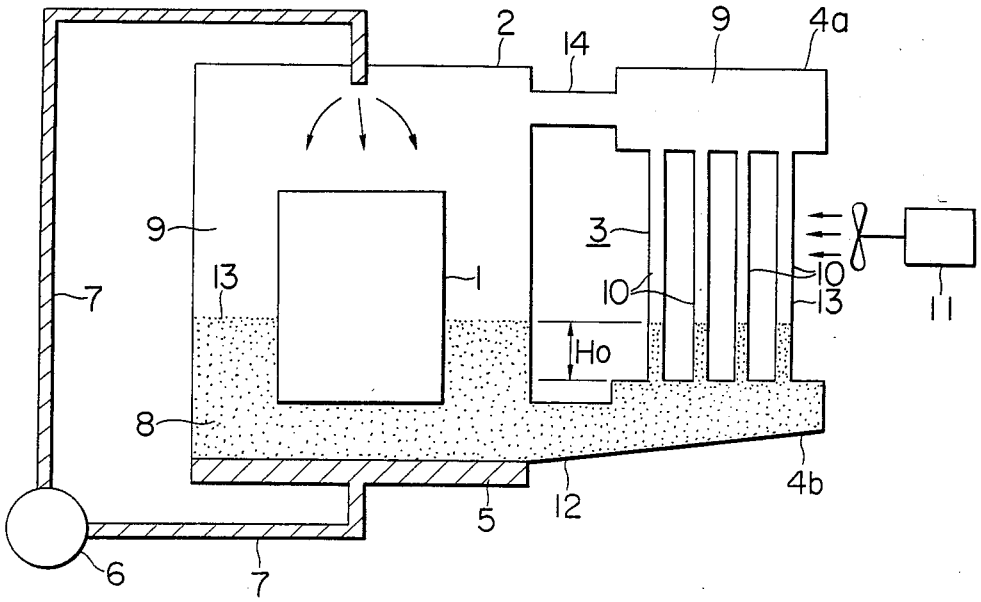
FIG. 1 is a schematic cross sectional view of the conventional evaporation cooled gas insulated electrical apparatus.
Figure 2:
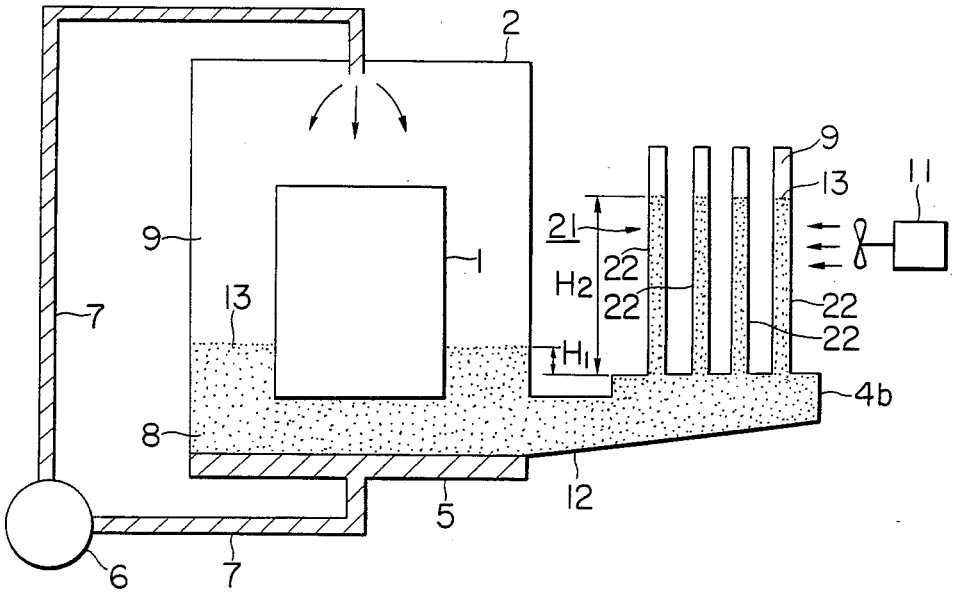
FIG. 2 is a schematic cross sectional view of an evaporation cooled gas insulated electrical apparatus according to a first embodiment of the present invention.

Referring to FIG. 2, a condenser 21 comprises a lower header **4*b* communicated to the lower portion of a tank 2, and a plurality of upstanding cooling ducts 22 extending upward from the lower header 4*b*. Each of the upper ends of the cooling ducts 22 is closed, so that fluid is communicated between the tank 2 and the ducts 22 only through the lower header 4*b*. This is the only difference between this embodiment and the conventional apparatus shown in FIG. 1. In other respect the structure is the same as that shown in FIG. 1**.

As mentioned before, the specific weight of the vapor refrigerant is chosen to be greater than the specific weight of the noncondensable gas.

Figure 3:
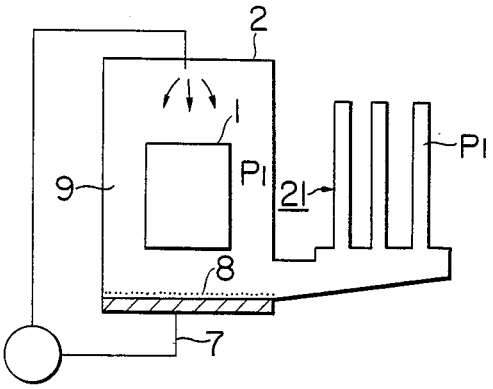
FIG. 3 is a schematic cross sectional view showing a state of the vapor refrigerant in which an electric device in FIG. 2 does not generate heat.

FIG. 3 shows a cooling state in which the electric device 1 does not generate heat from the interior thereof. Since the vapor pressure of the refrigerant is low at this time, a major part of the space within the tank 2 is filled with the noncondensable gas 9, where the interior of the tank 2 has a pressure of $P_1$.

Figure 4:
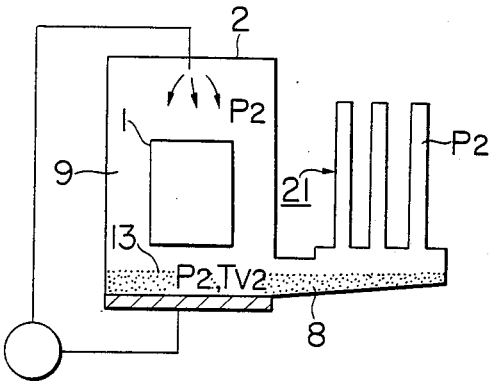
FIG. 4 is a schematic cross sectional view showing an initial state of heat generation of the electric device in FIG. 2.

FIG. 4 shows an initial transient state in which the electric device 1 begins to generate heat. A part of the liquid refrigerant 5 sprayed from a spout of the pipe 7 (from the top of the tank 2 in the Fig.) comes in contact with the electric device 1 and turns into vapor. This vapor refrigerant 8 flows downward and is gathered in the lower portion of the tank 2 due to the difference of specific weights between the vapor refrigerant 8 and the noncondensable gas 9, forming an interface 13 therebetween. At this time, a pressure $P_2$ of the noncondensable gas 9 is equal to a pressure $P_2$ of the vapor refrigerant 8, and the interface 13 is pushed by these same pressures, and kept in the equilibrium position thereof. The pressure $P_2$ is also a saturation pressure of the vapor refrigerant determined by a vapor temperature $T_{V2}$ at this time.

Figure 5:
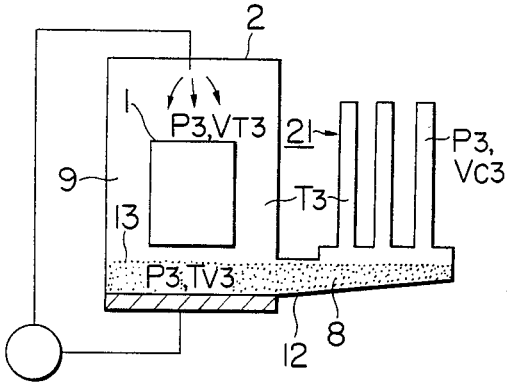
FIG. 5 is a schematic cross sectional view showing a state in which the uppermost surface of the vapor refrigerant in FIG. 2 has reached just below the upper end of the lower conduit.

When the electric device 1 further continues to generate heat, the quantity of the vapor refrigerant increases and the vapor temperature increases from $T_{V2}$ to $T_{V3}$. Thus, the vapor pressure increases from $P_2$ to $P_3$, thereby causing the noncondensable gas to more upward, so that the interface 13 reaches a point just below the upper end of the lower conduit 12, as shown in FIG. 5. In this state, since the noncondensable gas 9 in the tank 2 still communicates with the gas 9 in the condenser 21 through the lower conduit 12, the interface 13 is at the same level in both the tank 2 and the condenser 21. The volume of the noncondensable gas 9 above the interface 13 is $V_{T3}$ in the tank and $V_{C3}$ in the condenser. $T_3$ is an average temperature of the noncondensable gas 9 in the tank 2 and the condenser 21.

Figure 6:
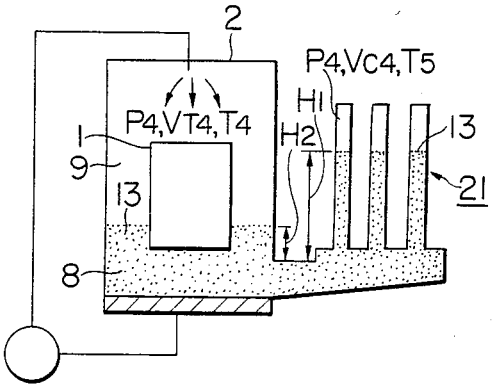
FIG. 6 is a schematic cross sectional view showing a state in which the electric device in FIG. 2 generates a lot of heat.

When the electric device 1 further generates heat and the vapor pressure increases from $P_3$ to $P_4$, the interface 13 passes the upper end of the lower conduit 12 and moves further upward, as shown in FIG. 6. In this state, the volume of the noncondensable gas 9 above the interface 13 is $V_{T4}$ on the tank side and $V_{C4}$ on the condenser side. Numerals $T_4$ and $T_5$ designate respective gas temperatures of the noncondensable gas 9 in the tank 2 and the condenser 21, where:

$$T_4 > T_5, \tag{1}$$

$T_4$ is greater than $T_5$ since the noncondensable gas 9 in the condenser 21 is far from the heat source of the electric device 1 and since the gas 9 in the condenser is cooled by a fan 11. In the state shown in FIG. 6, the interfaces 13 in the tank 2 and the condenser 21 are at different levels, and the respective volumes $V_{T4}$ and $V_{C4}$ can be determined by the following equations:

$$\frac{P_4 V_{T4}}{T_4} = \frac{P_3 V_{T3}}{T_3} \tag{2}$$

$$\frac{P_4 V_{C4}}{T_5} = \frac{P_3 V_{C3}}{T_3} \tag{3}$$

Accordingly, the following equations can be derived $$\frac{V_{T4}}{V_{T3}} = \frac{P_3 T_4}{P_4 T_3} \tag{4}$$

$$\frac{V_{C4}}{V_{C3}} = \frac{P_3 T_5}{P_4 T_3} \tag{5}$$

From equations (1), (4) and (5), a following inequality can be derived:

$$\frac{V_{T4}}{V_{T3}} > \frac{V_{C4}}{V_{C3}} \tag{6}$$

The inequality (6) implies that the rate of volume contraction of the noncondensable gas 9 in the condenser is greater than that in the tank. The cross sections of the tank 2 and the cooling ducts 22 are respectively uniform in the vertical direction thereof. Therefore, according to the inequality (6), as shown in FIG. 6, a level $H_1$ of the interface in the condenser and a level $H_2$ of the interface in the tank have the following relationship:

$$H_1 > H_2 \tag{7}$$

Figure 7:
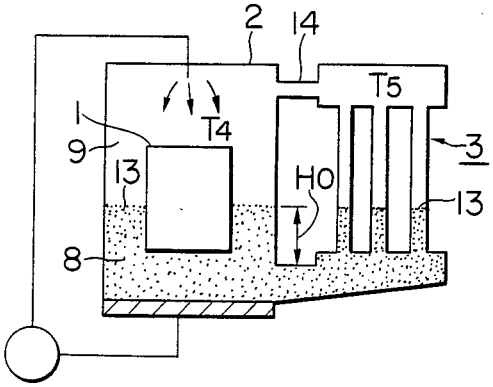
FIG. 7 is a schematic cross sectional view showing a state in the conventional apparatus corresponding to the state in FIG. 6.

FIG. 7 shows the state of the interfaces in the tank 2 and the condenser 3 according to the conventional apparatus. Although the condition $T_4 > T_5$ similarly occurs in the conventional apparatus, the condenser 3 is communicated with the tank 2 through the upper conduit 14 connected via the upper header 4a. Accordingly, the interfaces 13 in the tank 2 and the condenser 3 are at a common level of $H_o$, where:

$$H_1 > H_o > H_2. \tag{8}$$

Therefore, according to the above described first embodiment, a larger portion of the cooling ducts 22 can be filled with the vapor refrigerant, so that the dissipation area of the cooling ducts 22 is effectively used to dissipate heat and the area necessary to dissipate heat in the cooling ducts 22 can be reduced, permitting the condenser 21 to be compacter and lighter.

Figure 8:
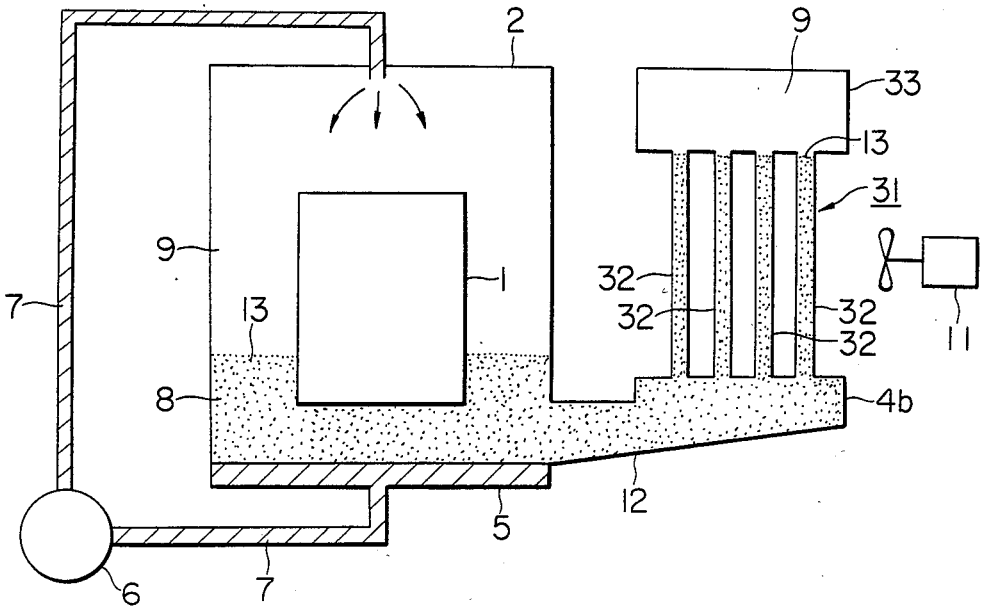
FIG. 8 is a schematic cross sectional view showing another embodiment.
Figure 9:
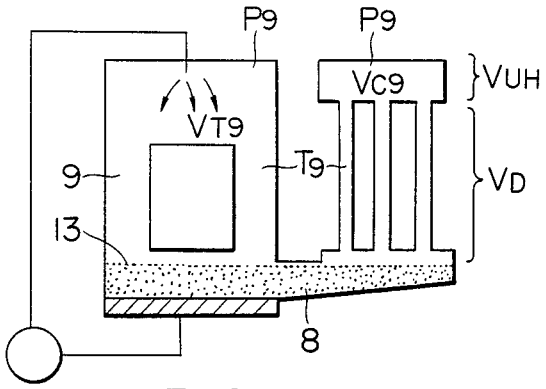
FIG. 9 is a schematic cross sectional view showing a state in the apparatus of FIG. 8 corresponding to the state in FIG. 5.
Figure 10:
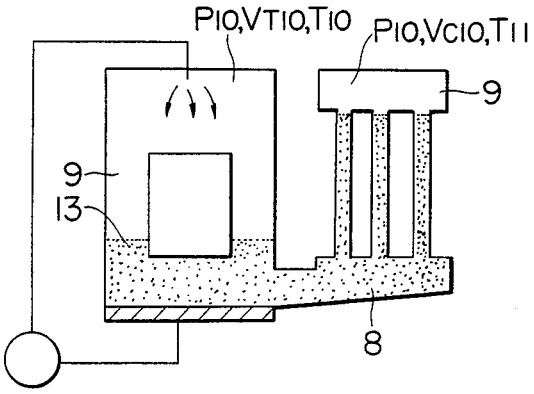
FIG. 10 is a schematic cross sectional view showing a state in the apparatus of FIG. 8 corresponding to the state in FIG. 6.

FIG. 8 shows another embodiment, where a common upper header 33 in a condenser 31 is not communicated with the tank 2 and communicates a plurality of cooling ducts 32 with each other at their upper ends. In this embodiment, a part of the noncondensable gas 9 is pushed upward into the common upper header 33, so that the cooling ducts 32 are filled with the vapor refrigerant 8 up to a higher level thereof, thereby more effectively utilizing the cooling area of the cooling ducts. In a first made of operation of the embodiment of FIG. 8 as shown in FIG. 9 which corresponds to the operation shown in FIG. 5, $P_9$ is an interior pressure of the tank 2 and the condenser 31, $T_9$ is an average temperature of the noncondensable gas, and $V_{T9}$ and $V_{C9}$ are volumes of the noncondensable gas above the interface 13 in the tank 2 and the condenser 31, respectively. In FIG. 10 corresponding to FIG. 6, $P_{10}$ is an interior pressure of the tank 2 and the condenser 31, $T_{10}$ and $T_{11}$ are temperatures of the noncondensable gas in the tank 2 and the condenser 31, respectively, and $V_{T10}$ and $V_{C10}$ are volumes of the noncondensable gas in the tank 2 and the condenser 31, respectively. Then, the following relation can be derived with respect the noncondensable gas in the condenser:

$$\frac{P_{10} V_{C10}}{T_{11}} = \frac{P_9 V_{C9}}{T_9} \tag{9}$$

Here, $V_{C9}$ is the sum of a total volume $V_D$ of the cooling ducts 32 and a total volume $V_{UH}$ of the upper header 33, i.e., $$V_{C9} = V_D + V_{UH}. \tag{10}$$

Since the noncondensable gas 9 is chosen to act as an insulating material, $T_9$ is approximately equal to $T_{11}$, i.e., $T_9 \approx T_{11}$, and so the equation (9) becomes:

$$P_{10} V_{C10} = P_9 V_{C9} \tag{11}$$

Here, the following inequality holds:

$$V_{UH} \geqq \frac{P_9}{P_{10} - P_9} V_D \tag{12}$$

and the inequality $$V_{C10} \leqq V_{UH} \tag{13}$$

can be derived from relations (10), (11) and (12).

Figure 11:
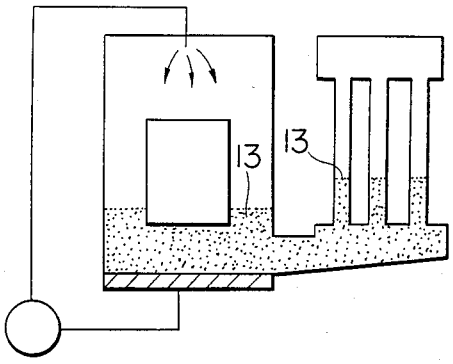
FIG. 11 is a schematic cross sectional view showing a state in which the load of the electric device in FIG. 8 is low.
Figure 12:
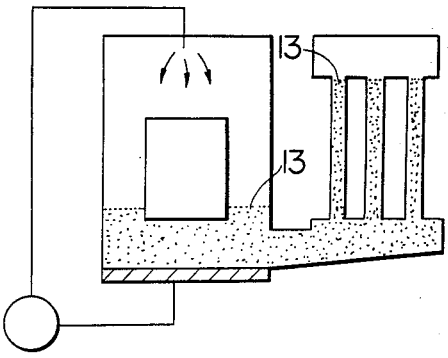
FIG. 12 is a schematic cross sectional view showing a state in which the load of the electric device in FIG. 8 is high.

Accordingly, when the volume $V_{UH}$ of the upper header 33 is chosen so as to form the inequality (12)

where $P_{10}$ is the vapor pressure of the refrigerant in a predetermined operational state of the apparatus, all of the noncondensable gas in the condenser is pushed upward into the upper header 33 in this operational state according to the inequality (13), so that all of the cooling ducts 32 are filled with the vapor refrigerant, effecitvely utilizing the whole area for heat dissipation of the condenser 31. Also, when the operational state in the vapor pressure of $P_{10}$ is set to be the maximum loading condition of the electric device, the electric device can be operated at a generally constant vapor pressure and vapor temperature throughout all the operationing loading conditions. Namely, when the electric device is operated in a low load condition, the vapor pressure is low and the cooling ducts are filled with the vapor refrigerant up to a level lower than the upper ends of the cooling ducts, so that the effective area for heat dissipation in the condenser is small as shown in FIG. 11. Therefore, the temperature and pressure of the vapor refrigerant increase and raise the interface 13 in the cooling ducts 32, thereby increasing the effective area for heat dissipation thereof. On the contrary, when the electric device is operated in a hight load condition, the vapor pressure is high causing the interface 13 to move above the upper ends of the cooling ducts 32, thereby increasing the effective area for heat dissipation as shown in FIG. 12. Therefore, the temperature and pressure of the vapor refrigerant decrease due to the cooling thereof and the interface 13 is thereby lowered, whereby the required area for heat dissipation of the cooling ducts 32 is reduced. Accordingly, the present electrical apparatus is operated in a stable state in which the pressure and temperature of the vapor refrigerant and the level of the interface in the cooling ducts 32 finally become generally constant under any loading conditions.

As mentioned above, the difference between the interface levels in the tank and the condenser occur after the interface has reached the upper end of the lower conduit 12. Therefore, when the lower header **4*b* is connected as close as possible to the bottom of the tank 2, and/or the lower conduit 12 is located as close as possible to the bottom of the tank 2**, the area for heat dissipation of the cooling ducts can be effectively utilized from a low pressure and low temperature of the vapor refrigerant.

Next, another embodiment will be explained with reference to the FIG. 13.

Figure 13:
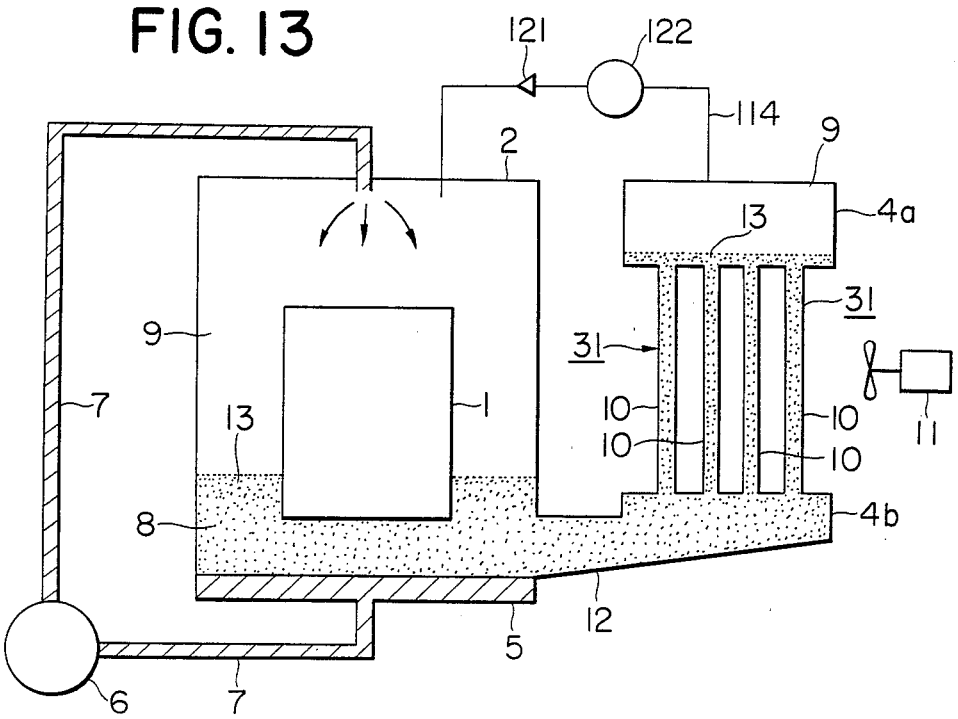
FIG. 13 is a schematic cross sectional view showing an another embodiment.

Referring to FIG. 13, a check valve 121 is disposed in an upper conduit 114 through which the upper header **4*a* is connected to the tank 2. The check valve 121 allows the noncondensable gas to pass from the upper header 4*a* to the tank 2, but does not allow it to pass from the tank 2 to the upper header 4*a*. A gas pump 122 is also disposed in the upper conduit 114 to pump the noncondensable gas in the upper header 4*a* to the tank 2 through the upper conduit 114. The remaining structure is similar to the one shown in FIG. 8**.

In the above embodiment, the operation of a cooling system will next be explained in a state in which the gas pump 122 is not driven.

In a state in which an interface 13 in the condenser 31 is formed between the noncondensable gas 9 and the vapor refrigerant 8, the vapor pressure increases as the vapor temperature increases, pushing the noncondensable gas 9 upward. Since the upper header **4*a* does not communicate with the tank 2 through the upper conduit 114 at this time, the noncondensable gas in the tank 2 and the noncondensable gas in the condenser 31 are separately compressed by the action of the check valve 121. When the volume of the tank 2 is larger e.g., by about 10 times than the total volume of the cooling ducts 10 in the condenser 31, a level shift $\Delta h$ of the interface i3 in the tank 2 by the increase of the vapor pressure corresponds to a level shift of about $10\Delta h$ of the interface in the cooling ducts 10, until the interface 13 in the condenser 3 reaches the upper ends of the cooling ducts 10. Therefore, the cooling ducts 10 are filled with the vapor refrigerant even due to small increases of the vapor pressure. Hence, the effective area for heat dissipation of the condenser 3 can be large in comparison with that of the conventional apparatus shown in FIG. 1**.

However, the following problems may occur in such a state:

(1) It is necessary to provide an upper header **4*a* having a large volume in order to allow all of the cooling ducts 10** to be filled with the vapor refrigerant, resulting in a large-sized apparatus.

(2). The noncondensable gas 9 also enters the condenser 31 together with the vapor refrigerant through the lower conduit 12 from the tank 2 and is gradually accumulated, so that the level of the interface 13 in the condenser 31 is gradually lowered, reducing the heat dissipation efficiency thereof.

In the above described states, it is necessary to discharge the noncondensable gas 9 from the condenser 31. Therefore, the case where the gas pump 122 is temporarily driven will next be explained.

Figure 14:
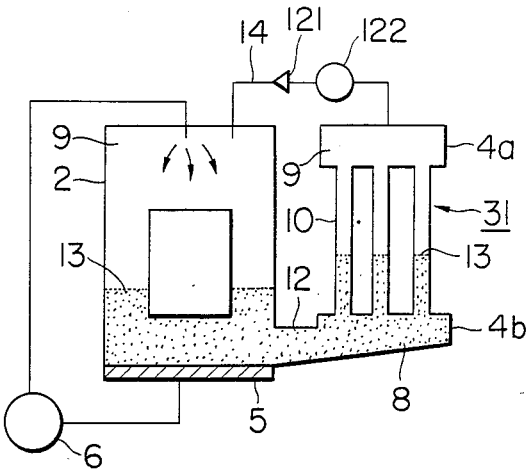
FIG. 14 is a schematic cross sectional view showing a state in which a little vapor refrigerant is generated in FIG. 13.
Figure 15:
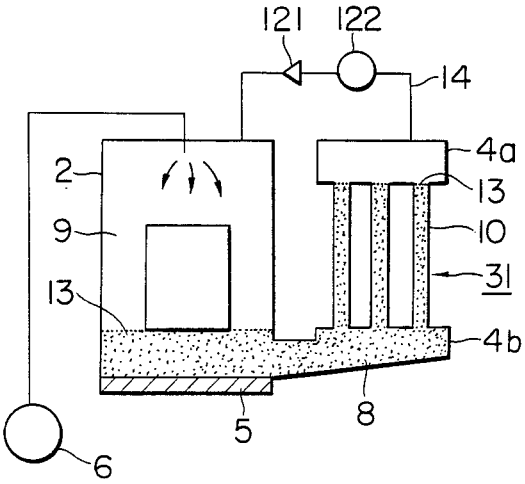
FIG. 15 is a schematic cross sectional view showing a state in which is large quantity of vapor refrigerant is generated in FIG. 13.

As shown in FIGS. 14 and 15, when the gas pump 122 is driven, the noncondensable gas 9 in the upper header **4*a* is transferred into the tank 2 and simultaneously the vapor refrigerant is raised upwardly within the cooling ducts 10, thereby increasing the effective heat dissipation area. Since the noncondensable gas 9 in the upper header 4*a* is transferred into the tank 2, it is not necessary to determine the volume of the upper header 4*a* as far as the volume of the cooling ducts 10, which allows the upper header 4*a* to be compact. Further, the apparatus can be continuously operated since the interface level in the condenser is not lowered by returning the accumulated noncondensable gas to the tank 2**.

The pressures in the tank 2 and the condenser 31 are equal to each other irrespective of the layers of the vapor refrigerant and the noncondensable gas. Accordingly, the balance of pressure between the tank 2 and the condenser 31 is maintained even when the operation of the gas pump 122 stops after the noncondensable gas has been transferred to the tank 2. Therefore, the raised level of the interface 13 in the condenser is not lowered as long as the noncondensable gas is not supplied into the condenser 3 through the lower conduit 12.

The gas pump 122 does not need to be continuously operated, but may be intermittently operated for maintaining the interface level in the condenser at a fixed level. When the gas pump 122 is continuously operated, it is necessary to set the discharge amount of the gas pump 122 such that the discharged quantity corresponds to the quantity of the gas accumulated in the upper header **4*a***, since the gas pump has a function for preventing the gas from flowing in the adverse direction.

Figure 16A:
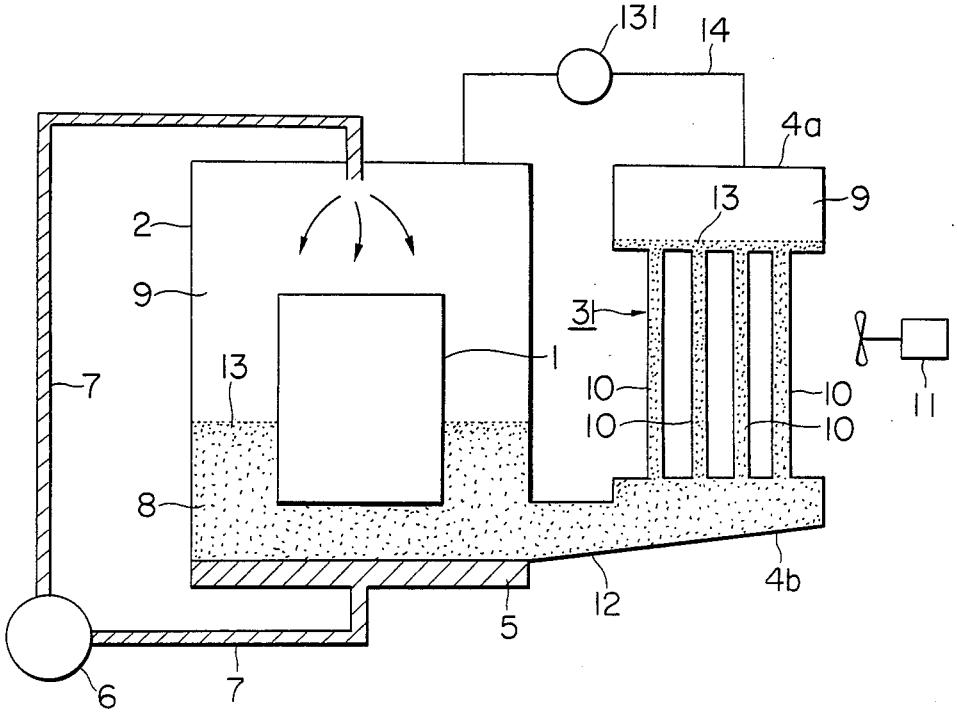
FIG. 16A is a schematic cross sectional view showing another embodiment.
Figure 16B:
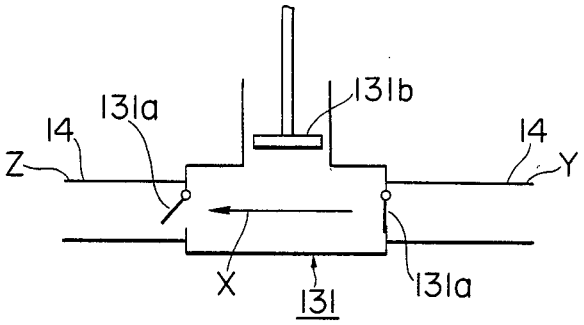
FIG. 16B is an enlarged schematic cross sectional view showing in detail the structure of a volume pump in FIG. 16A.

In stead of the check valve 121 and the gas pump 122 in the above embodiment, as shown in FIGS. 16A and 16B, a volume pump 131 incorporating check valves or one-way valves **131*a* disposed in the gas passage of the upper conduit 14 may be used to transfer the noncondensable gas 9 from the upper header 4***a* to the tank 2. The volume pump 131 has a function similar to the function of the check valve 121 and the gas pump 122. In FIG. 16B, the noncondensable gas 9 is pumped by a piston 131*b* of the volume pump 131 from the upper header side Y to the tank side Z in the direction shown by the arrow X. In this embodiment, since the check valves 131*a* are incorporated into the volume pump 131 as elements thereof so as to prevent the noncondensable gas from adversely flowing from the tank 2 to the upper header 4*a*, it is not necessary to separate dispose a check valve in the upper conduit, so that the apparatus becomes compacter and lighter and maintenance of the apparatus can be easily performed.

Figure 17:
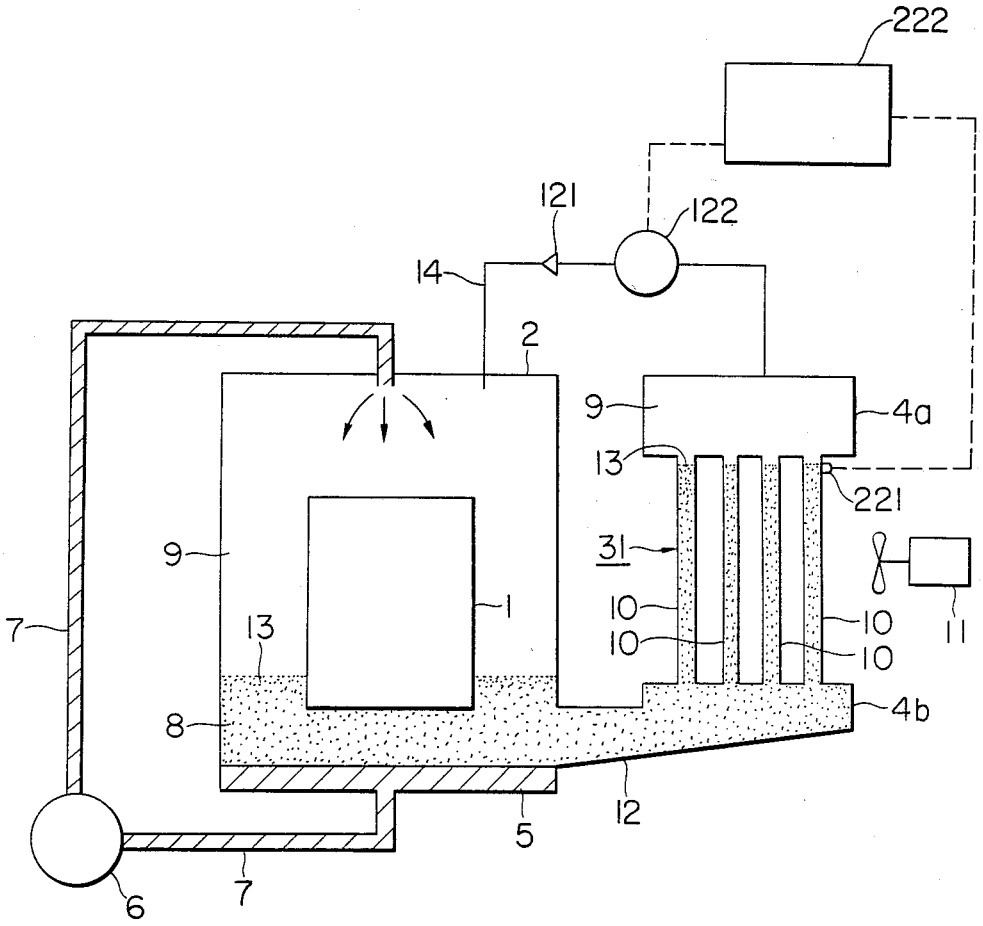
FIG. 17 is a schematic cross sectional view showing another embodiment.

FIG. 17, shows a further embodiment in which a sensing device 221 having sensors for sensing the interface 13 is attached to the condenser 3 and output signals from the sensors to a controller 222 for controlling the operation of the gas pump 122 such that the interface 13 is positioned at the same level as a predetermined reference level to dissipate heat in an optimal operating state of the condenser.

Figure 18:
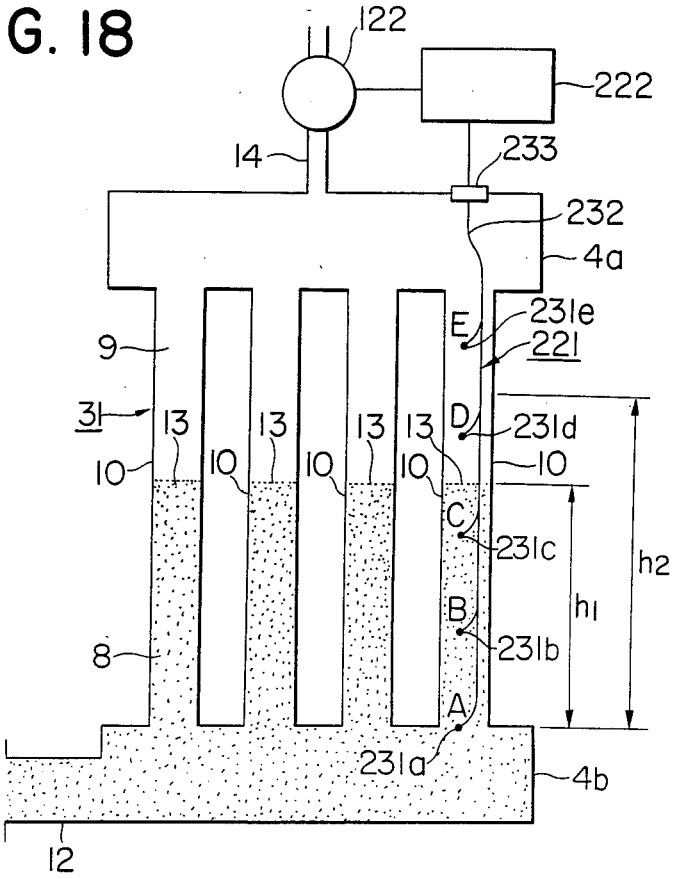
FIG. 18 is an enlarged schematic cross sectional view showing the sensing device in FIG. 17.

FIG. 18 illustrates in detail one embodiment of the sensing device 221 in which the sensing device 221 comprises a plurality of sensors, e.g. five thermocouples 231*a*, 231*b*, 231*c*, 231*d* and 231*e* respectively spaced by a predetermined distance in a cooling duct 10 and a load wire 232 for electrically connecting the thermocouples to the controller 222 through a hermetic seal 233. The thermoelectromotive forces generated from the thermocouples 231*a* to 231*e* are transmitted to the controller 222 through the lead wire 232.

Figure 19:
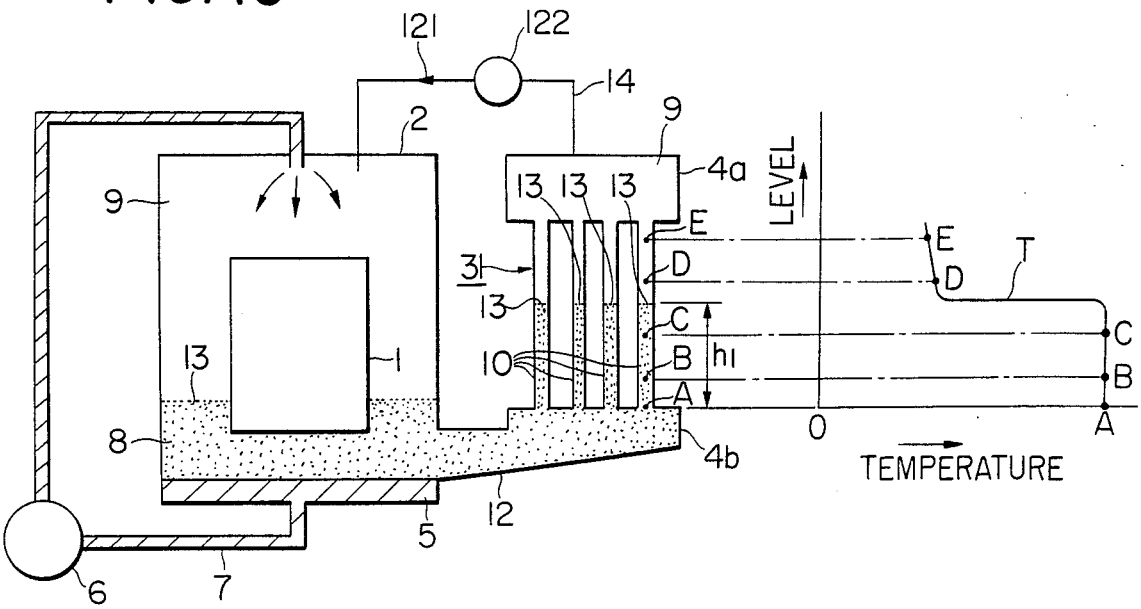
FIG. 19 is a schematic cross sectional view showing the relation between the level of the vapor refrigerant and the temperature within a cooling duct in the apparatus shown in FIGS. 17 and 18.

FIG. 19 exemplifies temperatures within the cooling duct 10 distributed to positions A to E in which the thermocouples 231*a* to 231*e* are respectively disposed, where $h_1$ is a level of the interface 13 in the cooling duct 10. The temperature within the cooling duct 10 is constantly high up to almost the level $h_1$ of the vapor refrigerant, and suddenly decreases above the level $h_1$ from which the noncondensable gas 9 fills the cooling duct 10. Accordingly, the thermo-electromotive force generated is high in thermocouples 231*a*, 231*b* and 231*c* at positions A. B and C respectively, and suddenly decreases in thermocouples 231*d* and 231*e* at positions D and E respectively, generating a difference T between thermo-electromotive forces. After this difference T is detected by the controller 222, it is sensed that the interface 13 is located between the position C and the position D.

In order to increase the efficiency of heat dissipation of the condenser, it is necessary to raise the interface 13 up to a reference level, e.g. a level of $h_2$ in FIG. 18 which is determined by the controller 222 according to the loading condition of the electric device 1. In this case, the gas pump 16 is operated by the controller 222 to discharge the noncondensable gas 9 above the interface 13 to the tank 2 so that the difference T between thermoelectromotive forces occurs when the interface 13 is located between the position D and the position E.

In the above embodiment, although the thermocouples are disposed in a cooling duct 10 as sensors of the sensing device 221, the thermocouples may be disposed in the outer wall of the cooling duct 10 to measure the temperature of the outer wall. Other sensing means may be used to measure the temperature of the cooling ducts without departing from the invention.

As mentioned above, according to one embodiment, a plurality of upstanding cooling ducts are closed at their upper ends and only a lower header disposed at the lower ends of the cooling docts communicates the tank with the cooling ducts, so that the interface between the vapor refrigerant and the noncondensable gas in the condenser is higher than the interface in the tank, thereby increasing the area for heat dissipation of the vapor refrigerant in the cooling ducts and thus the cooling efficiency thereof.

According to another embodiment, a check valve and a gas pump are disposed in an upper conduit connected to a common upper header communicating a plurality of cooling ducts with each other at their upper ends to the tank so as to discharge the noncondensable gas from the condenser to the tank and to prevent the noncondensable gas from adversely flowing from the tank to the condenser, so that the cooling ducts are completely filled with the vapor refrigerant thereby, increasing the cooling efficiency of the cooling ducts.

According to a further embodiment, a sensing device is disposed to sense the interface between the noncondensable gas and the vapor refrigerant in the cooling ducts, and a controller is disposed to compare the interface level sensed by the sensing device with a reference interface level set in the controller to control a gas pump to discharge the noncondensable gas from the condenser to the tank in such a manner that the actual interface level is in conformity with the reference interface level. Therefore, the interface can be shifted to an optimum position in response to the load conditions of an electric device disposed in the tank, whereby the condenser is operated at all times in an optimum state of heat dissipation for any load conditions of the electric device.

What is claimed is:

1. An evaporation cooled gas insulated electrical apparatus comprising:

an electric device generating heat when in operation;

a tank containing therein said electric device;

an electrically insulating noncondensable gas disposed within said tank;

an electrically insulating condensable liquid refrigerant disposed within said tank and having an interface with said noncondensable gas, said condensable liquid refrigerant being capable of evaporating into vapor refrigerant at the operating temperature of said electric device, and the specific weight of said vapor refrigerant being greater than the specific weight of said noncondensable gas; and a condenser connected to said tank for dissipating heat from said condensable refrigerant to condense said refrigerant into liquid comprising a first header connected to a lower portion of said tank, a plurality of upstanding cooling ducts extending from said header, and means including said first header connecting said cooling ducts in fluid communication with said tank and providing, under predetermined operating temperatures, an interface level between the vapor refrigerant and the noncondensable gas in the cooling ducts, which is higher than the interface level in the tank, to improve the cooling efficiency of the cooling ducts.

2. An evaporation cooled gas insulated electrical apparatus as claimed in claim 1, wherein each of the ducts in said plurality of cooling ducts is closed at its upper end.

3. An evaporation cooled gas insulated electrical apparatus as claimed in claim 1, wherein said cooling ducts are connected at their upper ends to a common second header.

4. An evaporation cooled gas insulated electrical apparatus as claimed in claim 1, wherein said first header is connected to the side wall of said tank close to the bottom wall of said tank.

5. An apparatus according to claim 1 wherein each of the ducts in said plurality of cooling ducts is connected at its upper end to said tank through a common connection, and wherein said means includes a gas pump and valve means in said common connection, and control means for controlling the operation of said gas pump to maintain said interface level in said ducts at a predetermined reference level higher than the interface level in said tank.

6. An evaporation cooled gas insulated electrical apparatus comprising:

an electric device generating heat when in operation;

a tank containing therein said electric device;

an electrically insulating noncondensable gas disposed within said tank;

an electrically insulating condensable refrigerant disposed within said tank, said condensable refrigerant being capable of evaporating into vapor refrigerant at the operating temperature of said electric device; and a condenser connected to said tank for dissipating heat from said condensable refrigerant;

said condenser comprising:

a lower header, a lower conduit connected to the lower portion of said tank for communicating said lower header to the interior of said tank, an upper header, an upper conduit connected to the upper portion of said tank for communicating said upper header to the interior of said tank, a plurality of upstanding cooling ducts extending between said upper and lower headers, and means including said upper and lower conduits controlling the communication with said tank and providing, under predetermined temperatures, a predetermined interface level between the vapor refrigerant and the noncondensable gas in the cooling ducts, said means including:

a check valve disposed in said upper conduit for allowing only the passage of said noncondensable gas from said upper header to said tank, and a gas pump disposed in said upper conduit for pumping said noncondensable gas from said upper header to said tank.

7. An evaporation cooled gas insulated electrical apparatus as claimed in claim 6, wherein said gas pump is adapted to be continuously operated during the operation of said electrical device, with the discharge amount of said pump corresponding to the rate of said noncondensable gas into said condenser.

8. An evaporation cooled gas insulated electrical apparatus as claimed in claim 6, wherein said check valve and said gas pump disposed in said upper conduit comprise a volume pump in which a one-way valve is incorporated.

9. An evaporation cooled gas insulated electrical apparatus, comprising:

an electric device generating heat when in operation;

a tank containing therein said electric device;

an electrically insulating noncondensable gas disposed within said tank;

an electrically insulating condensable refrigerant disposed within said tank, said condensable refrigerant being capable of evaporating at the operating temperature of said electrical device; and a condenser connected to said tank for dissipating heat from said condensable refrigerant;

said condenser comprising:

a lower header, a lower conduit connected to the lower portion of said tank for communicating said lower header to the interior of said tank, an upper header, an upper conduit connected to the upper portion of said tank for communicating said upper header to the interior of said tank, a plurality of upstanding cooling ducts extending between said upper and lower headers, a check valve disposed in said upper conduit for allowing only the passage of said noncondensable gas from said upper header to said tank, a gas pump disposed in said upper conduit for pumping said noncondensable gas from said upper header to said tank, a sensor means for detecting an interface between refrigerant vapor and said noncondensable gas, and a control means for controlling the operation of said gas pump in such a manner that said interface is positioned at the same level as a predetermined reference interface.

10. An evaporation cooled gas insulated electrical apparatus as claimed in claim 9, wherein said predetermined reference interface is set according to the loading condition of the electric device.

11. An evaporation cooled gas insulated electrical apparatus as claimed in claim 9, wherein said sensor means measures one of the temperatures in said cooling ducts and the temperature of an outer wall of said cooling ducts, and the level of the interface is determined from the measured temperature.

* * * * *